US008198875B2

(12) United States Patent
Sudou

(10) Patent No.: US 8,198,875 B2
(45) Date of Patent: Jun. 12, 2012

(54) VOLTAGE REGULATOR

(75) Inventor: Minoru Sudou, Austin, TX (US)

(73) Assignee: Seiko Instruments Inc., Chiba (JP)

( * ) Notice: Subject to any disclaimer, the term of this patent is extended or adjusted under 35 U.S.C. 154(b) by 435 days.

(21) Appl. No.: 12/559,966

(22) Filed: Sep. 15, 2009

(65) Prior Publication Data

US 2011/0062921 A1 Mar. 17, 2011

(51) Int. Cl.
*G05F 1/56* (2006.01)

(52) U.S. Cl. ..... 323/224; 323/274; 327/59

(58) Field of Classification Search ..... 323/279, 323/273–276, 280, 301, 223–224; 327/59, 327/66

See application file for complete search history.

(56) References Cited

U.S. PATENT DOCUMENTS 5,187,396 A * 2/1993 Armstrong et al. ..... 327/65
2008/0012543 A1* 1/2008 Negoro ..... 323/272

FOREIGN PATENT DOCUMENTS

JP 2001-051735 A 2/2001

* cited by examiner

*Primary Examiner* — Harry Behm
(74) *Attorney, Agent, or Firm* — Brinks Hofer Gilson & Lione

(57) ABSTRACT

Provided is a voltage regulator capable of securely preventing a reverse current from an output terminal (122) with lower current consumption, irrespective of magnitude of a voltage of a VDD terminal (121). Such a configuration is adopted that the voltage of the VDD terminal (121) and a voltage of the output terminal (122) of the voltage regulator are compared with each other with the use of a voltage generated between a transistor and a constant current circuit, to thereby reduce current consumption of a backup battery. Besides, such a configuration is also adopted that a gate of an output transistor is connected with the output terminal (122) based on an output of a comparator circuit, to thereby prevent the reverse current securely.

8 Claims, 9 Drawing Sheets

VOLTAGE REGULATOR

BACKGROUND OF THE INVENTION

1. Technical Field

The present invention relates to a voltage regulator whose output terminal is connected with a backup battery.

2. Background Art

Such a circuit as illustrated in FIG. 11 has been known as a conventional voltage regulator whose output terminal is connected with a backup battery 112 (see, for example, Patent Document 1).

Power supply voltage is applied between terminals, that is, a VDD terminal 121 and a VSS terminal 123. An output terminal 122 is connected with the backup battery 112, and even when the power supply voltage between the VDD terminal 121 and the VSS terminal 123 becomes zero, a load 113 (for example, RAM) may be continued to be supplied with voltage.

When the power supply voltage is being supplied between the VDD terminal 121 and the VSS terminal 123, and when the voltage between the terminals and the voltage of the backup battery are respectively represented by VBAT1 and VBAT2, "VBAT1>VBAT2" is normally established. When the power supply voltage is being supplied between the VDD terminal 121 and the VSS terminal 123, a Vref circuit 101 outputs a given constant voltage (Vref), and an error amplifier 102 amplifies a differential voltage between the voltage Vref and a voltage (R2/(R1+R2)×VOUT) determined by dividing the voltage (VOUT) of the output terminal 122 by means of a resistor 107 (whose resistance is R1) and a resistor 108 (whose resistance is R2). Accordingly, a gate of a Pch transistor 103 serving as an output transistor is controlled so that a constant voltage is output to the output terminal 122.

A comparator 1105 has a positive input terminal connected with a voltage determined by dividing the inter-terminal voltage between the VDD terminal 121 and the VSS terminal 123 by means of a resistor 1101 and a resistor 1102, and has a negative input terminal connected with a voltage determined by dividing an inter-terminal voltage between the output terminal 122 and the VSS terminal 123 by means of a resistor 1103 and a resistor 1104. Then, the comparator 1105 compares the terminal voltage of the VDD terminal 121 with the terminal voltage of the output terminal 122. When the power supply voltage is being supplied between the VDD terminal 121 and the VSS terminal 123, the voltage determined by the voltage division by means of the resistor 1101 and the resistor 1102 is higher than the voltage determined by the voltage division by means of the resistor 1103 and the resistor 1104. Therefore, an output of the comparator 1105 becomes "H", and then a Pch transistor 105 is turned ON while a Pch transistor 106 is turned OFF. Accordingly, with the Pch transistor 105, a substrate (Nwell) potential of the Pch transistor 103 becomes a potential of the VDD terminal 121.

On the other hand, when the inter-terminal voltage between the VDD terminal 121 and the VSS terminal 123 becomes lower than the inter-terminal voltage between the output terminal 122 and the VSS terminal 123, the output of the comparator 1105 becomes "L", and then the Pch transistor 106 is turned ON while the Pch transistor 105 is turned OFF. Accordingly, with the Pch transistor 106, the substrate (Nwell) potential of the Pch transistor becomes a potential of the output terminal 122.

In other words, by switching the substrate (Nwell) potential of the Pch transistor 103 to a higher one of the potentials on the VDD terminal 121 side and the output terminal 122 side, even when the voltage of the VDD terminal 121 becomes lower than the voltage of the output terminal 122, a current is prevented from flowing from the output terminal 122 to the VDD terminal 121 via a parasitic diode formed with a substrate of the Pch transistor 103.

Patent Document 1

JP 2001-51735 A

SUMMARY OF THE INVENTION

However, in the conventional voltage regulator, when the potential on the VDD terminal 121 side becomes zero, a current flows thereinto from the backup battery via the resistor 1103 and the resistor 1104. As a result, there arises a problem that a backup operation cannot be performed for a long time.

In addition, there arises another problem that a reverse current flows thereinto because the Pch transistor 103 cannot be turned OFF when the potential on the VDD terminal 121 side becomes zero.

Therefore, it is an object of the present invention to solve the conventional problems described above, and to provide a voltage regulator that is capable of, when the potential on the VDD terminal 121 side becomes zero, achieving lower current consumption of the backup battery and securely preventing the reverse current by turning OFF the Pch transistor 103.

The present invention solves the above-mentioned problems by adopting such a circuit configuration that voltage dividing resistors are not used for the circuit of comparing the voltage of the VDD terminal 121 with the voltage of the output terminal 122 of the voltage regulator, to thereby eliminate a current flowing through the voltage dividing resistors.

According to the voltage regulator of the present invention, which has the configuration described above, irrespective of the magnitude of the voltage of the VDD terminal 121, a reverse current may be prevented from flowing from the output terminal 122 to the VDD terminal 121 with lower current consumption.

DETAILED DESCRIPTION OF THE PREFERRED EMBODIMENTS

First Embodiment

Figure 1:
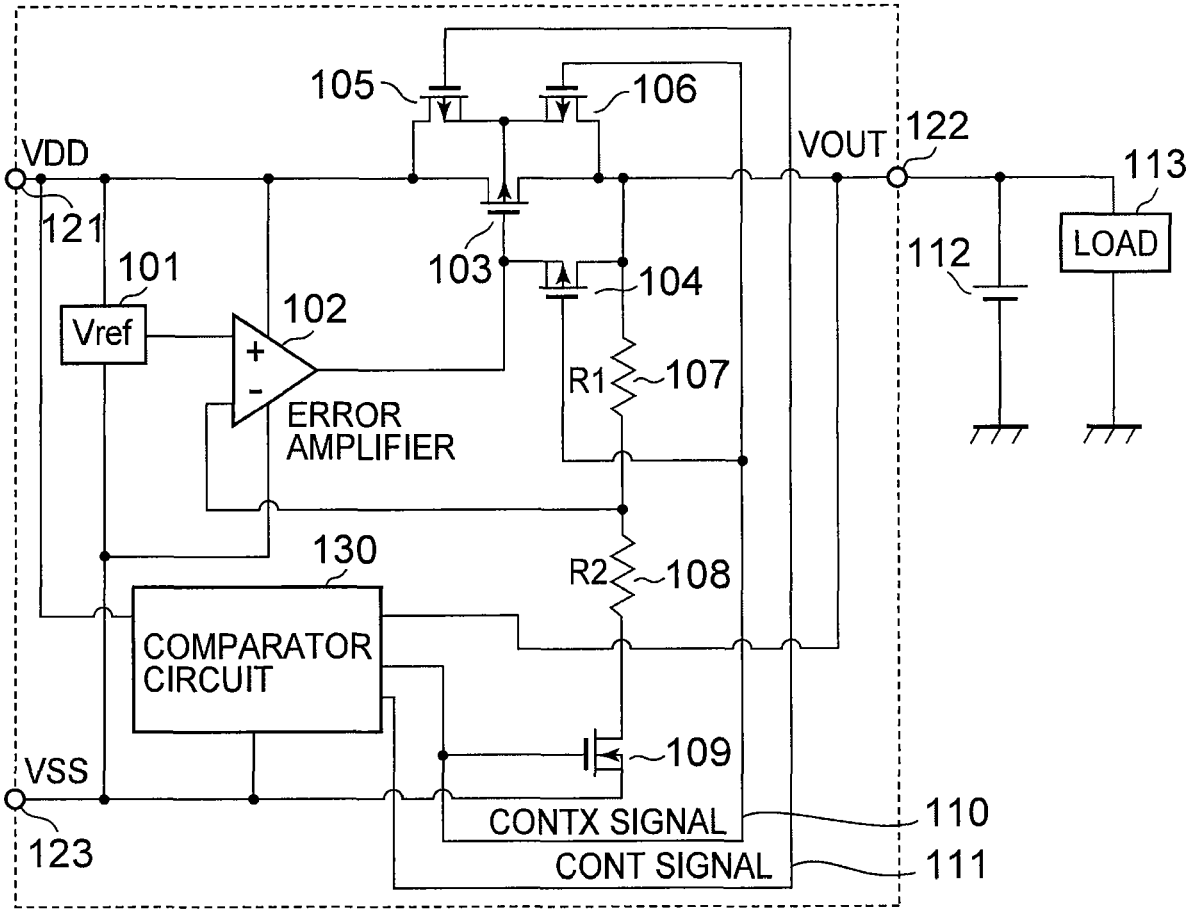
FIG. 1 is a circuit diagram illustrating a voltage regulator according to the present invention.

FIG. 1 is a circuit diagram illustrating a voltage regulator according to a first embodiment of the present invention. The voltage regulator according to the present invention includes a Vref circuit 101, an error amplifier 102, a comparator circuit 130, a resistor 107, a resistor 108, a Pch transistor 103 serving as an output transistor, a Pch transistor 104, a Pch transistor 105, a Pch transistor 106, an Nch transistor 109, a VDD terminal 121, a VSS terminal 123, and an output terminal 122.

Figure 11:
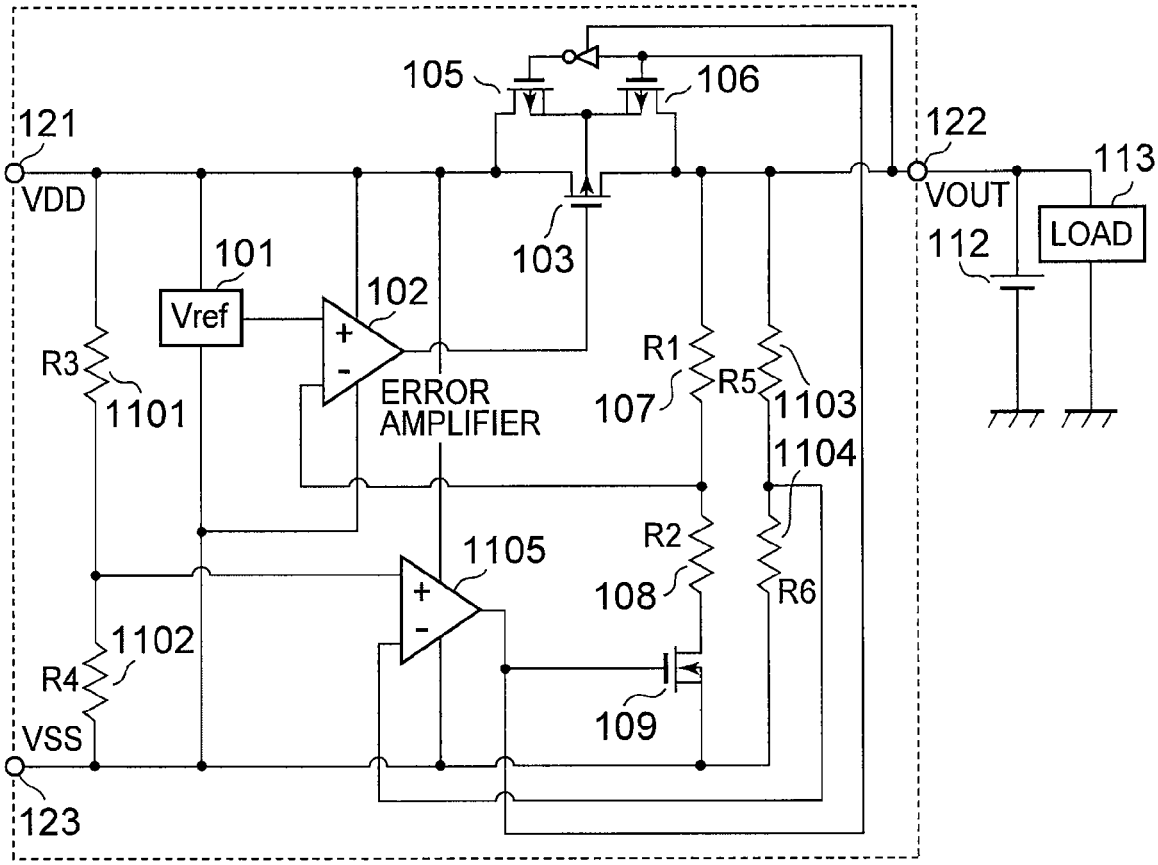
FIG. 11 PRIOR ART
FIG. 11 is a circuit diagram illustrating a conventional voltage regulator.

A difference from FIG. 11 resides in that the comparator 1105 and the resistors 1101, 1102, 1103, and 1104 are eliminated and the comparator circuit 130 controls the Pch transistors 105 and 106 and the added Pch transistor 104.

Figure 2:
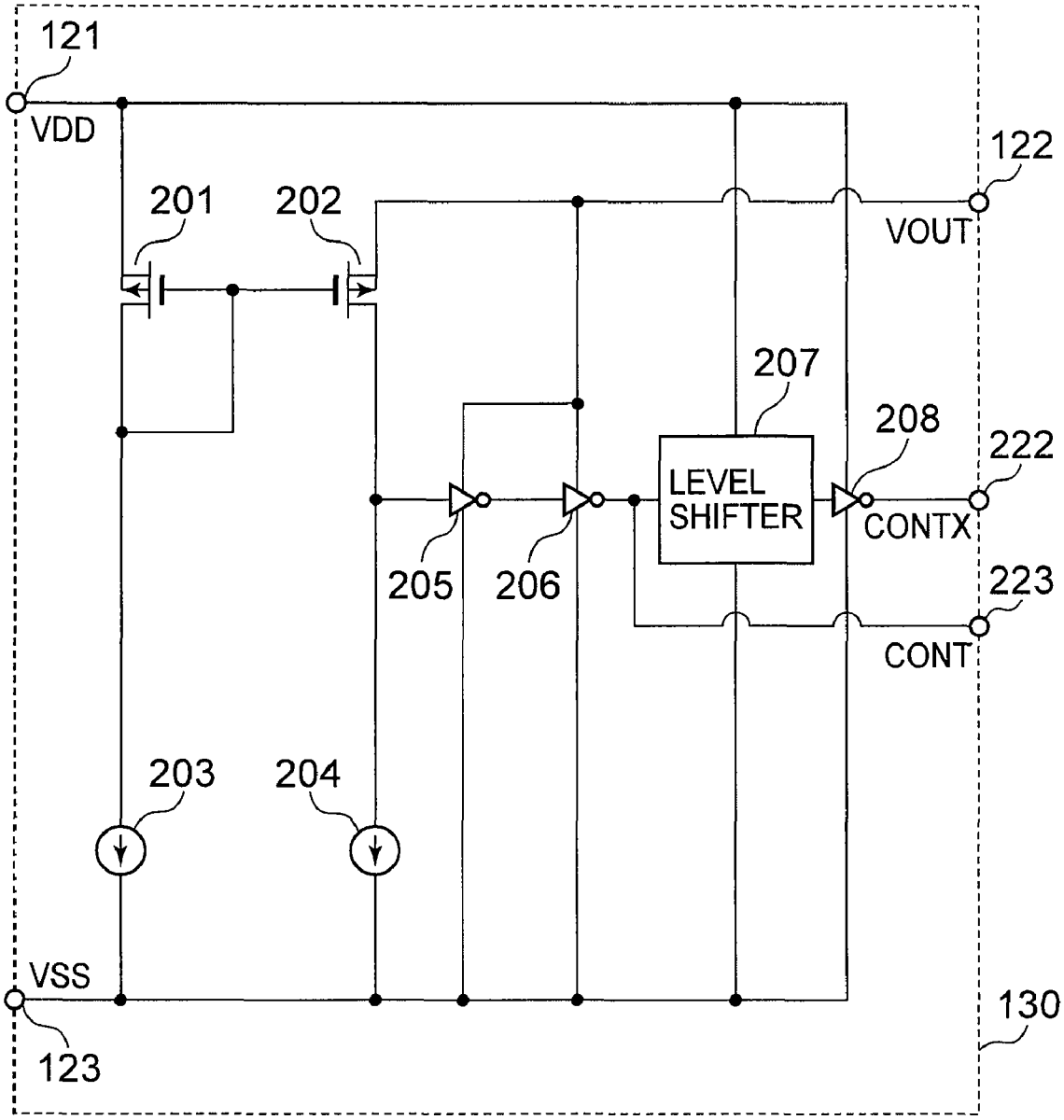
FIG. 2 is a circuit diagram illustrating a comparator circuit of the voltage regulator according to a first embodiment of the present invention.

FIG. 2 illustrates a circuit diagram of the comparator circuit according to the present invention.

The comparator circuit 130 includes a constant current circuit 203, a constant current circuit 204, a Pch transistor 201, a Pch transistor 202, an inverter 205, an inverter 206, an inverter 208, and a level shifter 207.

A description is given of connections in the voltage regulator according to the present invention. An output of the Vref circuit is connected to a non-inverting input terminal of the error amplifier 102. An inverting input terminal of the error amplifier 102 is connected with a connection point between the resistor 107 and the resistor 108, and an output thereof is connected to a gate of the Pch transistor 103 and a source of the Pch transistor 104. A source of the Pch transistor 103 is connected with the VDD terminal 121 and a drain of the Pch transistor 105. A drain of the Pch transistor 103 is connected to the output terminal 122 and a drain of the Pch transistor 106. A back gate of the Pch transistor 103 is connected with a source of the Pch transistor 105 and a source of the Pch transistor 106. A gate of the Pch transistor 105 is connected with a node 111, and a back gate thereof is connected with the source of the Pch transistor 105. A gate of the Pch transistor 106 is connected with a node 110, and a back gate thereof is connected with the source of the Pch transistor 106. A drain of the Pch transistor 104 is connected to the output terminal 122. A gate of the Pch transistor 104 is connected with the node 110, and a back gate thereof is connected with the output of the error amplifier 102. One side of the resistor 107 is connected with the output terminal 122 while another side thereof is connected with the resistor 108. A gate of the Nch transistor 109 is connected with the node 110. A drain of the Nch transistor 109 is connected with the resistor 108, and a source thereof is connected to the VSS terminal 123. The comparator circuit 130 is connected to the output terminal 122, the VDD terminal 121, the VSS terminal 123, the node 110, and the node 111. The output terminal 122 is connected with a backup battery 112 and a load 113 that are connected in parallel.

Next, a description is given of connections in the comparator circuit 130. A gate of the Pch transistor 201 is connected with a gate of the Pch transistor 202, a drain of the Pch transistor 201, and the constant current circuit 203. A source of the Pch transistor 201 is connected with the VDD terminal 121, and a back gate thereof is connected with the VDD terminal 121. A drain of the Pch transistor 202 is connected to the inverter 205 and the constant current circuit 204. A source of the Pch transistor 202 is connected with the output terminal 122, and a back gate thereof is connected with the output terminal 122. An output of the inverter 205 is connected to the inverter 206, and the inverter 205 is connected with the output terminal 122 for its power supply. An output of the inverter 206 is connected to the level shifter 207 and a CONT terminal 223, and the inverter 206 is connected with the output terminal 122 for its power supply. An output of the level shifter 207 is connected to the inverter 208, and the level shifter 207 is connected with the VDD terminal 121 for its power supply. An output of the inverter 208 is connected to a CONTX terminal 222, and the inverter 208 is connected with the VDD terminal 121 for its power supply. The CONT terminal 223 is connected with the node 111 of FIG. 1 while the CONTX terminal 222 is connected with the node 110 of FIG. 1.

Next, a description is given of operations of the voltage regulator according to the present invention. When a potential of the VDD terminal 121 is higher than a potential of the output terminal 122, the Pch transistor 201 is turned ON while the Pch transistor 202 is turned OFF. Accordingly, a potential of the drain of the Pch transistor 202 becomes "L" level (potential of the VSS terminal 123). With the inverters 205 and 206 for waveform shaping, a voltage of the CONT terminal 223, to which the output of the inverter 206 is connected, becomes "L" level. The level shifter 207 converts the potential level of the output terminal 122 to the potential level of the VDD terminal 121. The inverter 208 inverts an output voltage of the level shifter 207. When the voltage of the CONT terminal 223 is "L" level, the CONTX terminal 222, which corresponds to the output of the inverter 208, has the potential level of the VDD terminal 121. On this occasion, a substrate (Nwell) potential of the Pch transistor 103 illustrated in FIG. 1 becomes the potential of the VDD terminal 121 because the Pch transistor 105 is turned ON while the Pch transistor 106 is turned OFF. In other words, the substrate (Nwell) potential of the Pch transistor 103 becomes a higher one of the potential of the VDD terminal 121 and the potential of the output terminal 122. On this occasion, the Pch transistor 104 is turned OFF. When the VDD terminal 121 is connected with a power source, the potential of the VDD terminal 121 normally becomes higher than the potential of the output terminal 122.

On the other hand, when no power source is connected to the VDD terminal 121, the potential of the VDD terminal 121 becomes lower than the potential of the output terminal 122 because the output terminal 122 is connected with the backup battery 112. On this occasion, the Pch transistor 202 is turned ON while the Pch transistor 201 is turned OFF. Accordingly, the potential of the drain of the Pch transistor 202 becomes "H" level (potential of the output terminal 122). With the inverters 205 and 206 for waveform shaping, the voltage of the CONT terminal 223, which corresponds to the output of the inverter 206, becomes "H" level (potential of the output terminal 122). The level shifter 207 converts the potential level of the output terminal 122 to the potential level of the VDD terminal 121. The inverter 208 inverts the output voltage of the level shifter 207. When the voltage of the CONT terminal 223 is "H" level (potential of the output terminal 122), the voltage of the CONTX terminal 222, which corresponds to the output of the inverter 208, is "L" level (potential level of the VSS terminal 123). On this occasion, the substrate (Nwell) potential of the Pch transistor 103 illustrated in FIG. 1 becomes the potential of the output terminal 122 because the Pch transistor 106 is turned ON while the Pch transistor 105 is turned OFF. In other words, the substrate (Nwell) potential of the Pch transistor 103 becomes a higher one of the potential of the VDD terminal 121 and the potential of the output terminal 122. On this occasion, the Pch transistor 104 is turned ON, and accordingly the gate of the Pch transistor 103 is allowed to have the same potential as the output terminal 122 so that the Pch transistor 103 is turned OFF. With this, even when the potential of the VDD terminal 121 becomes lower than the potential of the output terminal 122, a current may be prevented by the Pch transistor 103 from flowing from the output terminal 122 to the VDD terminal 121.

Figure 7:
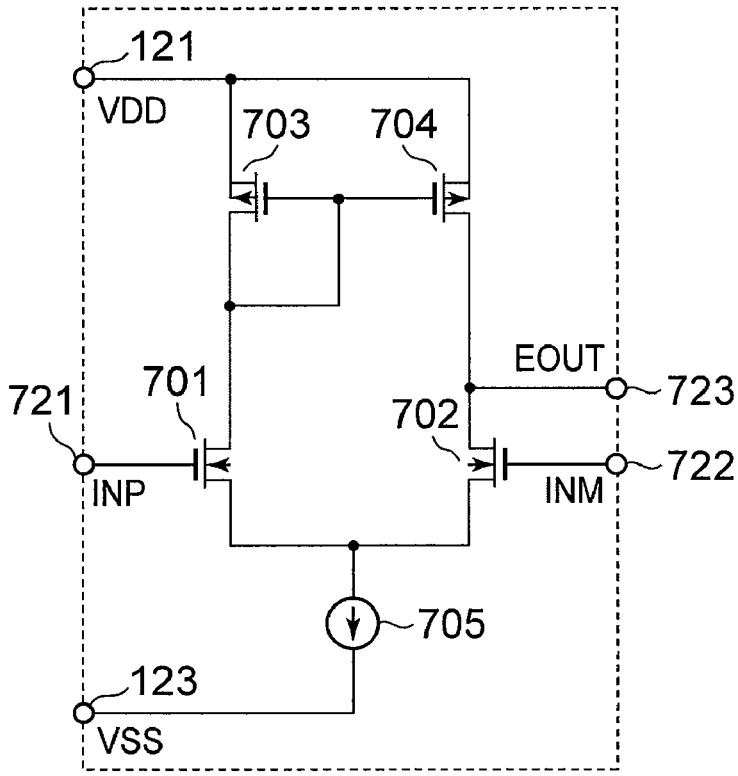
FIG. 7 is a circuit diagram of a general error amplifier of a voltage regulator.
Figure 8:
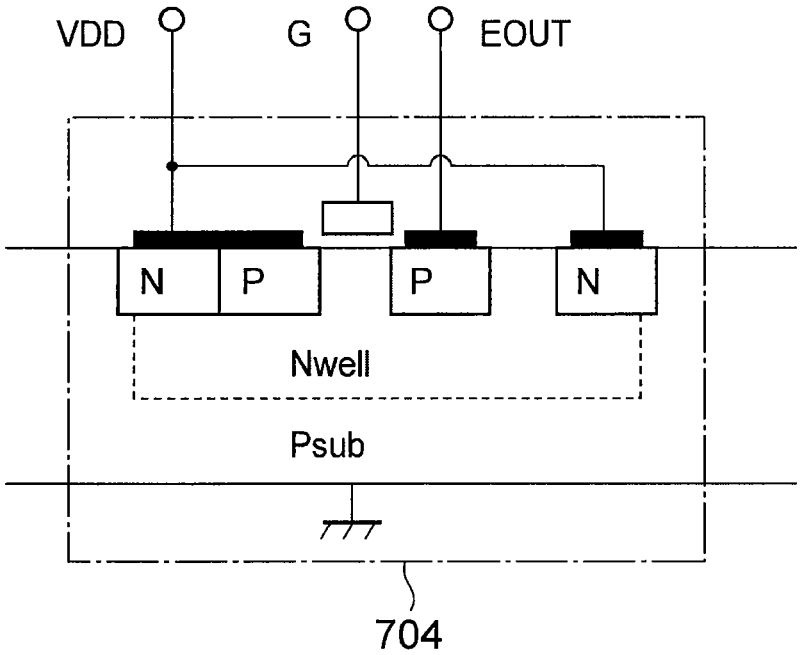
FIG. 8 is a cross sectional view of a P-channel type MOS transistor.

Next, a description is given of the error amplifier 102, which is used in FIG. 1. A configuration of a general error amplifier is as illustrated in FIG. 7. The error amplifier includes a constant current circuit 705, Nch transistors 701 and 702, and Pch transistors 703 and 704. The positive input terminal, the negative input terminal, and the output of the error amplifier are respectively represented by INP 721, INM 722, and EOUT 723. Further, FIG. 8 illustrates a cross sectional view of the Pch transistor 704. Within an Nwell formed on a P-substrate, there exist P-type source and drain regions. The P-substrate is connected to the VSS terminal 123, whose potential is lower. Further, the Nwell is connected with its source (VDD terminal 121).

In a case of using the general error amplifier illustrated in FIG. 7, when the potential of the output terminal 122 becomes higher than the potential of the VDD terminal 121, and when the Pch transistor 104 is accordingly turned ON, the output 723 of the error amplifier 102 is connected to the output terminal 122. At this time, in the case of the general error amplifier circuit illustrated in FIG. 7, a PNP transistor whose emitter, base, and collector respectively correspond to the drain, the source, and the substrate of the transistor 704 is turned ON. As a result, the backup battery 112 is discharged via the Pch transistor 104. To avoid this phenomenon, it is desirable to adopt such a configuration as illustrated in FIG. 9 for the error amplifier circuit.

Figure 9:
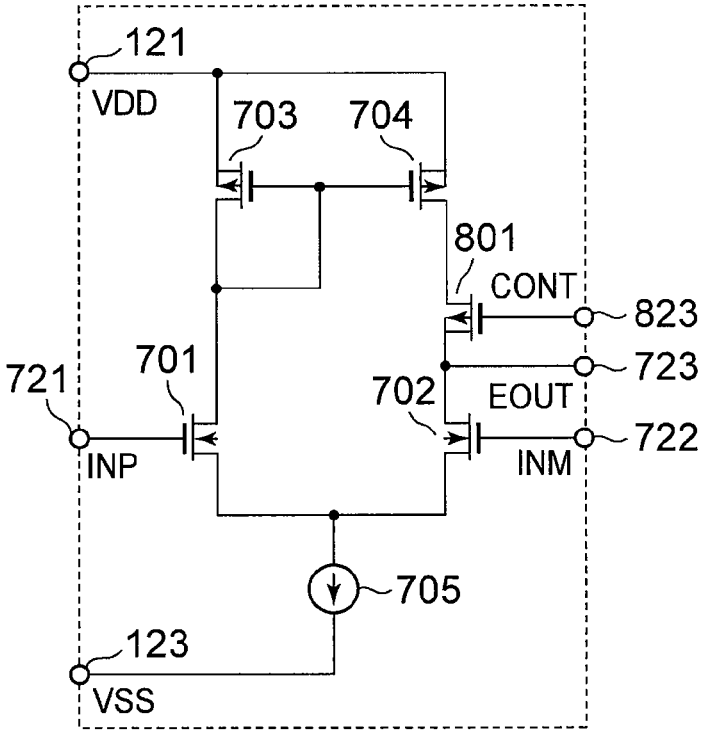
FIG. 9 is a circuit diagram of an error amplifier of the voltage regulator according to the present invention.
Figure 10:
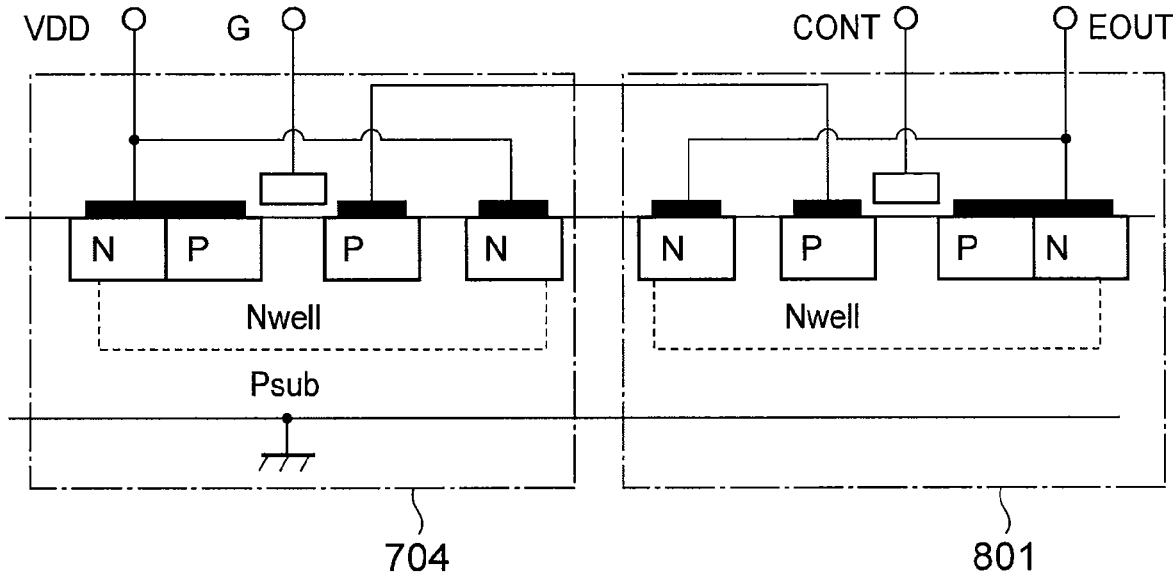
FIG. 10 illustrates cross sectional views of P-channel type MOS transistors.

In an error amplifier circuit illustrated in FIG. 9, a Pch transistor 801 is newly added between the output 723 of the error amplifier and the Pch transistor 704. The Pch transistor 801 has a source and an Nwell that are connected with the output 723 of the error amplifier, a drain connected with the drain of the Pch transistor 704, and a gate controlled by a signal from the node 111 illustrated in FIG. 1. FIG. 10 illustrates cross sectional views of the Pch transistors 704 and 801. In this case, when the potential of the output terminal 122 becomes higher than the potential of the VDD terminal 121, and when the Pch transistor 104 is accordingly turned ON, the output 723 of the error amplifier 102 is connected to the output terminal 122. However, the signal from the node 111 becomes the same potential as the output terminal 122, and accordingly the Pch transistor 801 is turned OFF. Therefore, a current is not allowed to flow from the drain of the Pch transistor 801 to the drain of the Pch transistor 704.

As described above, compared to the conventional voltage regulator illustrated in FIG. 11, the resistor 1101, the resistor 1102, the resistor 1103, and the resistor 1104 are not provided for comparing the potential of the VDD terminal 121 with the potential of the output terminal 122. As a result, current consumption may be reduced correspondingly. For example, when it is assumed that the voltage of the backup battery 112 is 3 V and a total resistance of the resistor 1103 and the resistor 1104 is 3 MegΩ, a current of 1 μA from the backup battery 112 is consumed by the resistor 1103 and the resistor 1104. However, in the voltage regulator illustrated in FIG. 1, there is no element equivalent to those resistors, resulting in no consumption corresponding thereto. It is assumed that the comparator 1105 illustrated in FIG. 11 and the comparator circuit 130 illustrated in FIG. 2 have the same current consumption of 0.5 μA. On this occasion, the voltage regulator illustrated in FIG. 11 consumes 1.5 μA from the backup battery 112 whereas the voltage regulator illustrated in FIG. 1 consumes only 0.5 μA therefrom, which is one-third of 1.5 μA. As a result, an operation time period with the backup battery 112 may be extended significantly.

Second Embodiment

Figure 3:
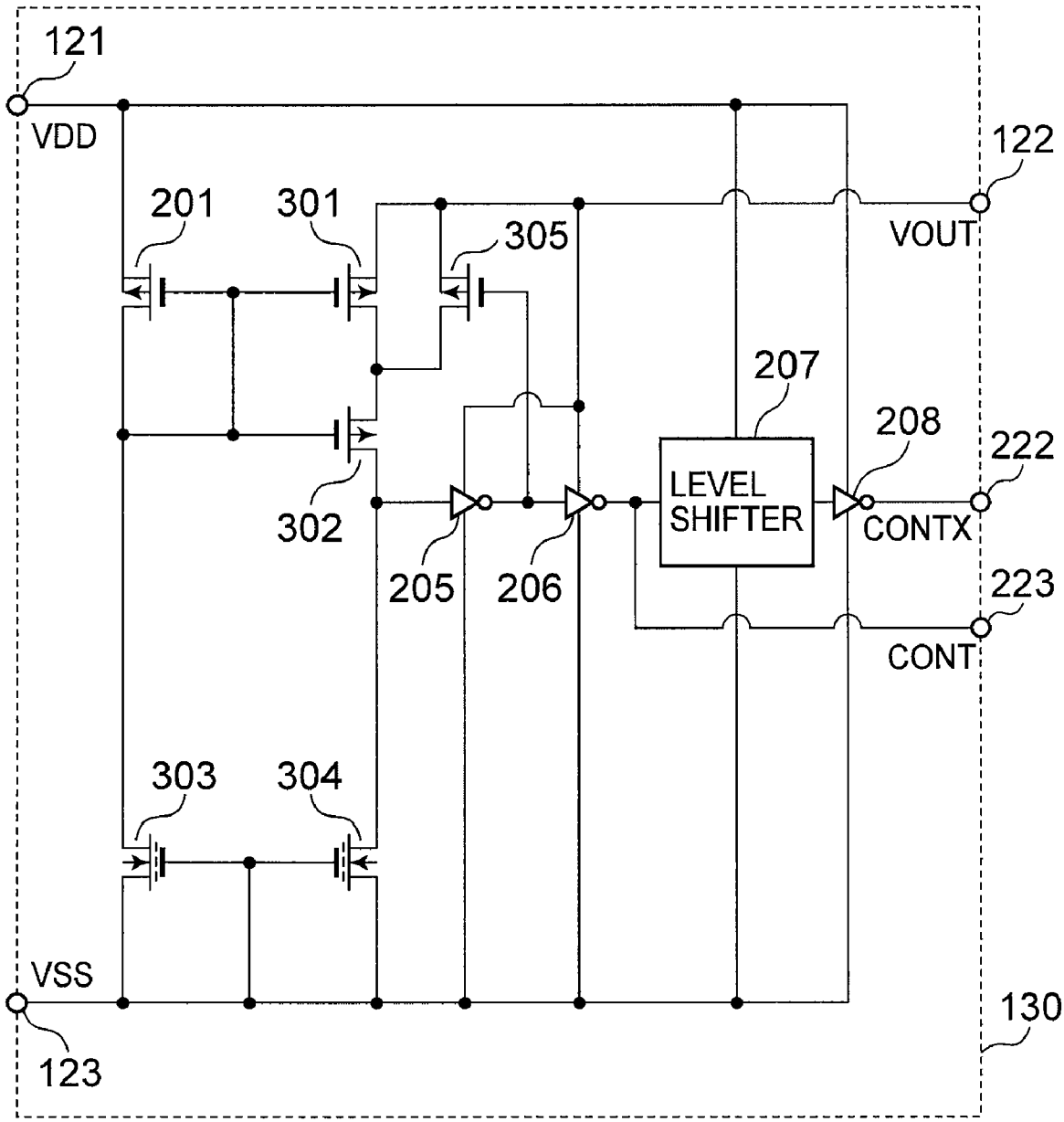
FIG. 3 is a circuit diagram illustrating a comparator circuit of the voltage regulator according to a second embodiment of the present invention.

FIG. 3 illustrates a comparator circuit 130 of the voltage regulator illustrated in FIG. 1 according to a second embodiment of the present invention. The comparator circuit 130 according to the second embodiment includes a constant current circuit 303, a constant current circuit 304, the Pch transistor 201, a Pch transistor 301, a Pch transistor 302, a Pch transistor 305, the inverter 205, the inverter 206, the inverter 208, and the level shifter 207. Differences from FIG. 2 reside in that an element equivalent to the Pch transistor 202 is formed of the two transistors, that is, the Pch transistor 301 and the Pch transistor 302, and that the Pch transistor 305 is added for realizing a hysteresis function. Further, each of the constant current circuit 203 and the constant current circuit 204 is specifically illustrated as an N-channel depletion type MOS transistor whose gate and source are connected to the VSS terminal 123.

Next, a description is given of connections in the comparator circuit 130. The gate of the Pch transistor 201 is connected with a gate of the Pch transistor 301, a gate of the Pch transistor 302, a drain of the Pch transistor 201, and the constant current circuit 303. The source of the Pch transistor 201 is connected with the VDD terminal 121, and the back gate thereof is connected with the VDD terminal 121. A drain of the Pch transistor 302 is connected to the inverter 205 and the constant current circuit 304. A source of the Pch transistor 302 is connected with a drain of the Pch transistor 301 and a drain of the Pch transistor 305, and a back gate thereof is connected with the output terminal 122. A source of the Pch transistor 301 is connected with the output terminal 122, and a back gate thereof is connected with the output terminal 122. A gate of the Pch transistor 305 is connected with the output of the inverter 205. A source of the Pch transistor 305 is connected with the output terminal 122, and a back gate thereof is connected with the output terminal 122. The output of the inverter 205 is connected to the inverter 206, and the inverter 205 is connected with the output terminal 122 for its power supply. The output of the inverter 206 is connected to the level shifter 207 and the CONT terminal 223, and the inverter 206 is connected with the output terminal 122 for its power supply. The output of the level shifter 207 is connected to the inverter 208, and the level shifter 207 is connected with the VDD terminal 121 for its power supply. The output of the inverter 208 is connected to the CONTX terminal 222, and the inverter 208 is connected with the VDD terminal 121 for its power supply. The N-channel depletion type MOS transistors are used as the constant current circuit 303 and the constant current circuit 304. Each of the N-channel depletion type MOS transistors has the gate and the source that are connected to the VSS terminal 123, and a drain used as its output. The CONT terminal 223 is connected with the node 111 of FIG. 1 while the CONTX terminal 222 is connected with the node 110 of FIG. 1.

Next, a description is given of operations of the voltage regulator, which uses the comparator circuit according to the second embodiment. When the potential of the VDD terminal 121 is higher than the potential of the output terminal 122, the Pch transistor 201 is turned ON while the Pch transistor 301 and the Pch transistor 302 are turned OFF. Accordingly, a potential of the drain of the Pch transistor 302 becomes "L" level (potential of the VSS terminal 123). With the inverters 205 and 206 for waveform shaping, the output of the inverter 205 becomes "H" (potential of the output terminal 122). Then, the Pch transistor 305 is turned OFF, and the voltage of the CONT terminal 223, which corresponds to the output of the inverter 206, becomes "L" level. The level shifter 207 converts the potential level of the output terminal 122 to the potential level of the VDD terminal 121. The inverter 208 inverts the output voltage of the level shifter 207. When the voltage of the CONT terminal 223 is "L" level, the CONTX terminal 222, which corresponds to the output of the inverter 208, has the potential level of the VDD terminal 121. On this occasion, the substrate (Nwell) potential of the Pch transistor 103 becomes the potential of the VDD terminal 121 because the Pch transistor 105 is turned ON while the Pch transistor 106 is turned OFF. In other words, the substrate (Nwell) potential of the Pch transistor 103 becomes a higher one of the potential of the VDD terminal 121 and the potential of the output terminal 122. On this occasion, the Pch transistor 104 is turned OFF. When the VDD terminal 121 is connected with a power source, the potential of the VDD terminal 121 normally becomes higher than the potential of the output terminal 122.

Subsequently, when the potential of the VDD terminal 121 decreases, because the Pch transistor 305 is turned OFF, the voltage of the VDD terminal 121 is compared with the voltage of the output terminal 122 by means of the Pch transistor 201 and a compound transistor formed of the Pch transistor 301 and the Pch transistor 302. When the potential of the VDD terminal 121 decreases to a potential lower by ΔV1 than the potential of the output terminal 122, the Pch transistor 201 is turned OFF while the Pch transistor 301 and the Pch transistor 302 are turned ON. Accordingly, the potential of the drain of the Pch transistor 302 becomes "H" level (potential of the output terminal 122). With the inverters 205 and 206 for waveform shaping, the output of the inverter 205 becomes "L" level. Then, the Pch transistor 305 is turned ON, and the voltage of the CONT terminal 223, which corresponds to the output of the inverter 206, becomes "H" level (potential of the output terminal 122). The level shifter 207 converts the potential level of the output terminal 122 to the potential level of the VDD terminal 121. The inverter 208 inverts the output voltage of the level shifter 207. When the voltage of the CONT terminal 223 is "H" level, the CONTX terminal 222, which corresponds to the output of the inverter 208, is "L" level. On this occasion, the substrate (Nwell) potential of the Pch transistor 103 illustrated in FIG. 1 becomes the potential of the output terminal 122 because the Pch transistor 106 is turned ON while the Pch transistor 105 is turned OFF. In other words, the substrate (Nwell) potential of the Pch transistor 103 becomes a higher one of the potential of the VDD terminal 121 and the potential of the output terminal 122. On this occasion, the Pch transistor 104 is turned ON, and accordingly the gate of the Pch transistor 103 is allowed to have the same potential as the output terminal 122 so that the Pch transistor 103 is turned OFF.

The voltage of ΔV1 is determined by Expression (1).

$$\Delta V1 = \sqrt{\frac{2 \cdot I}{\mu \cdot Cox}} \times \left( \sqrt{\frac{L6}{W6}} - \sqrt{\frac{L5}{W5}} \right) \quad (1)$$

In Expression (1), I represents a current value of the constant current circuits 303 and 304; μ, mobility of the Pch transistor 201, the Pch transistor 301, and the Pch transistor 302; L6, a total transistor L-length of the Pch transistor 301 and the Pch transistor 302; L5, a transistor L-length of the Pch transistor 201; W6, a transistor W-length of the Pch transistor 301 and the Pch transistor 302; and W5, a transistor W-length of the Pch transistor 201.

Subsequently, when the potential of the VDD terminal 121 increases, because the Pch transistor 305 is turned ON, the voltage of the VDD terminal 121 is compared with the voltage of the output terminal 122 by means of the transistors of the Pch transistor 201 and the Pch transistor 302. In the cases where the constant current circuits 303 and 304 have the same current value, and where the Pch transistor 201 and the Pch transistor 302 have the same transistor types (VTH, mobility, and the like), the same L-length, and the same W-length, ΔV1 in Expression (1) satisfies "ΔV1=0". Therefore, when the voltage of the VDD terminal 121 and the voltage of the output terminal 122 are substantially equal to each other, the voltage of the CONT terminal 223 and the voltage of the CONTX terminal 222 are inverted.

Figure 4:
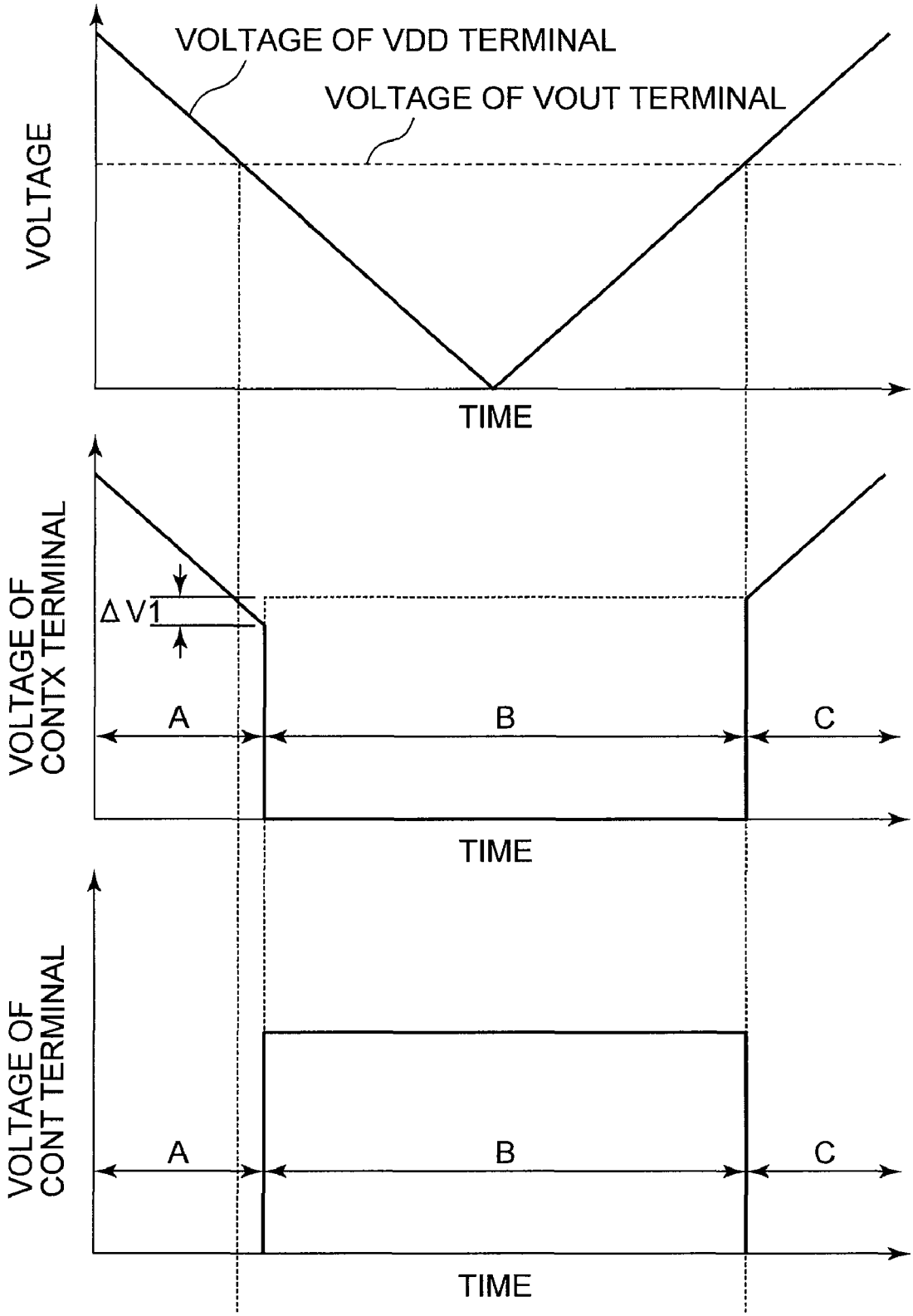
FIG. 4 illustrates voltage waveforms of respective portions of the voltage regulator according to the second embodiment of the present invention.

FIG. 4 illustrates voltage waveforms of the CONT terminal 223 and the CONTX terminal 222 of when the voltage of the output terminal 122 is constant while the voltage of the VDD terminal 121 changes. When the voltage of the VDD terminal 121 decreases to a voltage lower by ΔV1 than the voltage of the output terminal 122, the voltage of the CONT terminal 223 and the voltage of the CONTX terminal 222 are inverted. Thereafter, the voltage of the VDD terminal 121 is raised, and when the voltage of the VDD terminal 121 becomes equal to the voltage of the output terminal 122, the voltage of the CONT terminal 223 and the voltage of the CONTX terminal 222 are inverted. As described above, hysteresis is provided between the voltage of the VDD terminal 121 and the voltage of the output terminal 122, between which the substrate (Nwell) potential of the Pch transistor 103 is switched over. This enables the switching-over of the substrate (Nwell) potential of the Pch transistor 103 to be securely performed without a malfunction even when the voltage of the VDD terminal 121 and the voltage of the output terminal 122 become approximate to each other.

Note that, in order to prevent a parasitic diode formed between the output terminal 122 and the substrate of the Pch transistor 103 from being turned ON when the voltage of the VDD terminal 121 decreases, the value of ΔV1 needs to be set to a forward ON voltage (about 0.6 V) or lower of the parasitic diode. In general, the value of ΔV1 is set to about 50 mV to 200 mV.

Further, the Pch transistor 305 is connected in parallel with the Pch transistor 301 in FIG. 3, but it is obvious that a similar effect may be obtained when the Pch transistor 305 is connected in parallel with the Pch transistor 302. Further, as has been described in the first embodiment, with regard to the error amplifier, it is desirable to adopt the configuration illustrated in FIG. 9 similarly to the first embodiment.

Third Embodiment

Figure 5:
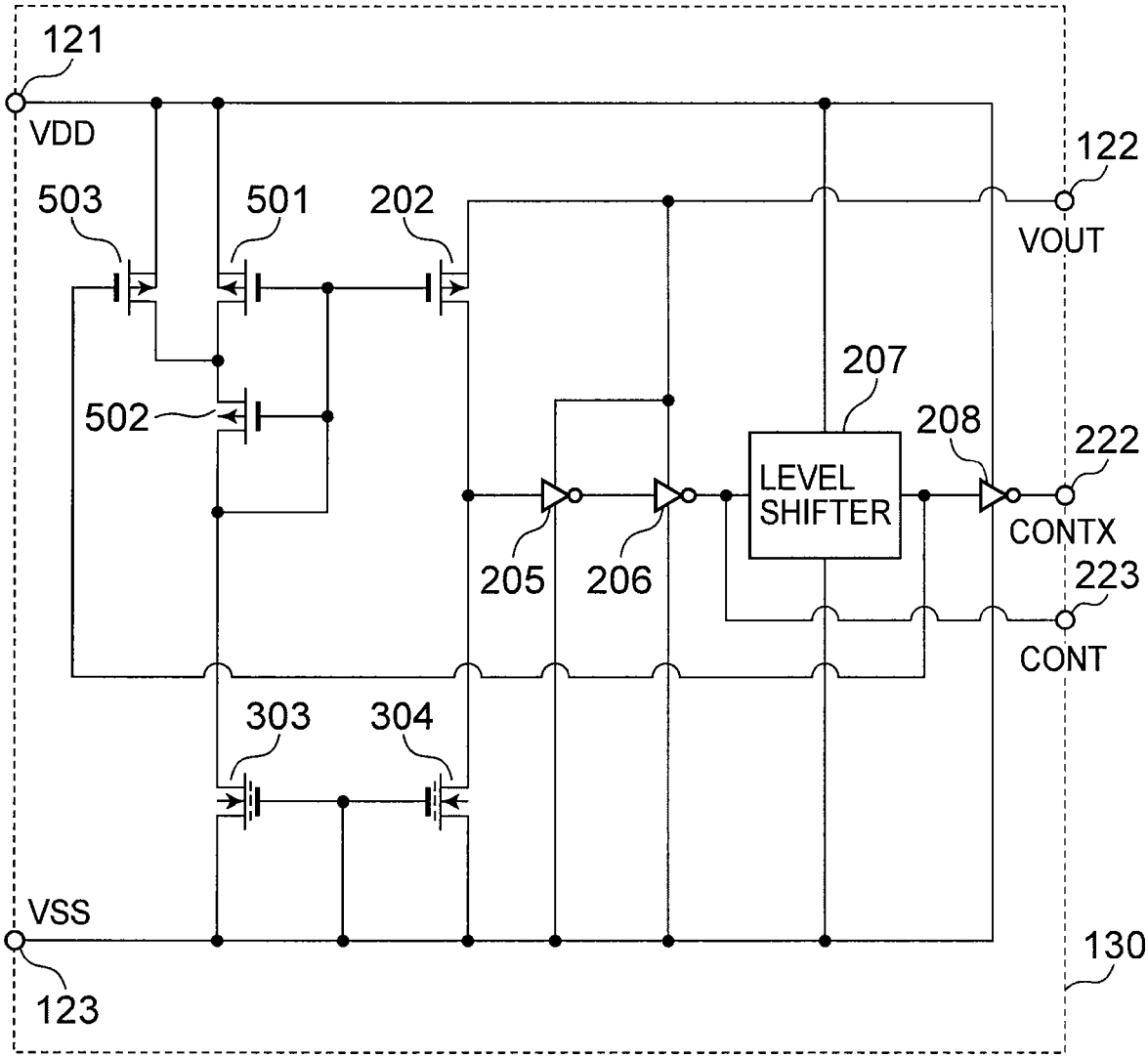
FIG. 5 is a circuit diagram illustrating a comparator circuit of the voltage regulator according to a third embodiment of the present invention.

FIG. 5 illustrates a comparator circuit 130 of the voltage regulator illustrated in FIG. 1 according to a third embodiment of the present invention. The comparator circuit 130 according to the third embodiment includes the constant current circuit 303, the constant current circuit 304, the Pch transistor 202, a Pch transistor 501, a Pch transistor 502, a Pch transistor 503, the inverter 205, the inverter 206, the inverter 208, and the level shifter 207. Differences from FIG. 2 reside in that an element equivalent to the Pch transistor 201 is formed of the two transistors, that is, the Pch transistor 501 and the Pch transistor 502, and that the Pch transistor 503 is added for realizing a hysteresis function. Further, similarly to FIG. 3, each of the constant current circuits 203 and 204 is specifically illustrated as the N-channel depletion type MOS transistor whose gate and source are connected to the VSS terminal 123.

Next, a description is given of connections in the comparator circuit 130. A gate of the Pch transistor 501 is connected with the gate of the Pch transistor 202, a gate of the Pch transistor 502, a drain of the Pch transistor 502, and the constant current circuit 303. A source of the Pch transistor 501 is connected with the VDD terminal 121. A drain of the Pch transistor 501 is connected with a source of the Pch transistor 502 and a drain of the Pch transistor 503, and a back gate thereof is connected with the VDD terminal 121. A gate of the Pch transistor 503 is connected with the output of the level shifter 207. A source of the Pch transistor 503 is connected with the VDD terminal 121, and a back gate thereof is connected with the VDD terminal 121. The drain of the Pch transistor 202 is connected to the inverter 205 and the constant current circuit 304. A source of the Pch transistor 202 is connected with the output terminal 122, and a back gate thereof is connected with the output terminal 122. The output of the inverter 205 is connected to the inverter 206, and the inverter 205 is connected with the output terminal 122 for its power supply. The output of the inverter 206 is connected to the level shifter 207 and the CONT terminal 223, and the inverter 206 is connected with the output terminal 122 for its power supply. The output of the level shifter 207 is connected to the inverter 208, and the level shifter 207 is connected with the VDD terminal 121 for its power supply. The output of the inverter 208 is connected to the CONTX terminal 222, and the inverter 208 is connected with the VDD terminal 121 for its power supply. The N-channel depletion type MOS transistors are used as the constant current circuit 303 and the constant current circuit 304. Each of the N-channel depletion type MOS transistors has the gate and the source that are connected to the VSS terminal 123, and a drain used as its output. The CONT terminal 223 is connected with the node 111 of FIG. 1 while the CONTX terminal 222 is connected with the node 110 of FIG. 1.

Next, a description is given of operations of the voltage regulator, which uses the comparator circuit according to the third embodiment. When the potential of the VDD terminal 121 is sufficiently higher than the potential of the output terminal 122, the Pch transistor 501 and the Pch transistor 502 are turned ON while the Pch transistor 202 is turned OFF. Accordingly, the potential of the drain of the Pch transistor 202 becomes "L" level (potential of the VSS terminal 123). With the inverters 205 and 206 for waveform shaping, the CONT terminal 223, which corresponds to the output of the inverter 206, becomes "L" level. The level shifter 207 converts the potential level of the output terminal 122 to the potential level of the VDD terminal 121. The inverter 208 inverts the output voltage of the level shifter 207. When the voltage of the CONT terminal 223 is "L" level, the output of the level shifter 207 is "L" level. Accordingly, the Pch transistor 503 is turned ON, and the CONTX terminal 222, which corresponds to the output of the inverter 208, has the potential level of the VDD terminal 121. On this occasion, the substrate (Nwell) potential of the Pch transistor 103 illustrated in FIG. 1 becomes the potential of the VDD terminal 121 because the Pch transistor 105 is turned ON while the Pch transistor 106 is turned OFF. In other words, the substrate (Nwell) potential of the Pch transistor 103 becomes a higher one of the potential of the VDD terminal 121 and the potential of the output terminal 122. On this occasion, the Pch transistor 104 is turned OFF. When the VDD terminal 121 is connected with a power source, the potential of the VDD terminal 121 normally becomes higher than the potential of the output terminal 122.

Subsequently, when the potential of the VDD terminal 121 decreases, because the Pch transistor 503 is turned ON, the voltage of the VDD terminal 121 is compared with the voltage of the output terminal 122 by means of the Pch transistor 502 and the Pch transistor 202. In the cases where the constant current circuits 303 and 304 have the same current value, and where the Pch transistor 502 and the Pch transistor 202 have the same transistor types (VTH, mobility, and the like), the same L-length, and the same W-length, when the potential of the VDD terminal 121 decreases to substantially the same value as the potential of the output terminal 122, the Pch transistor 502 is turned OFF while the Pch transistor 202 is turned ON. Accordingly, the potential of the drain of the Pch transistor 202 becomes "H" level (potential of the output terminal 122). With the inverters 205 and 206 for waveform shaping, the voltage of the CONT terminal 223, which corresponds to the output of the inverter 206, becomes "H" level (potential of the output terminal 122). The level shifter 207 converts the potential level of the output terminal 122 to the potential level of the VDD terminal 121. The inverter 208 inverts the output voltage of the level shifter 207. When the voltage of the CONT terminal 223 is at "H" level, the output of the level shifter 207 corresponds to the voltage of the VDD terminal 121. Accordingly, the Pch transistor 503 is turned OFF, and the CONTX terminal 222, which corresponds to the output of the inverter 208, becomes "L" level. On this occasion, the substrate (Nwell) potential of the Pch transistor 103 becomes the potential of the output terminal 122 because the Pch transistor 106 is turned ON while the Pch transistor 105 is turned OFF. In other words, the substrate (Nwell) potential of the Pch transistor 103 becomes a higher one of the potential of the VDD terminal 121 and the potential of the output terminal 122. On this occasion, the Pch transistor 104 is turned ON, and accordingly the gate of the Pch transistor 103 is allowed to have the same potential as the output terminal 122 so that the Pch transistor 103 is turned OFF.

Subsequently, when the potential of the VDD terminal 121 increases, because the Pch transistor 503 is turned OFF, the voltage of the VDD terminal 121 is compared with the voltage of the output terminal 122 by means of the Pch transistor 202 and a compound transistor formed of the Pch transistor 501 and the Pch transistor 502. When the voltage of the VDD terminal 121 increases to a voltage higher by ΔV2 than the voltage of the output terminal 122, the voltage of the CONT terminal 223 and the voltage of the CONTX terminal 222 are inverted.

The voltage of ΔV2 is determined by Expression (2).

$$\Delta V2 = \sqrt{\frac{2 \cdot I}{\mu \cdot Cox}} \times \left( \sqrt{\frac{L5}{W5}} - \sqrt{\frac{L6}{W6}} \right) \tag{2}$$

In Expression (2), I represents a current value of the constant current circuits 303 and 304; μ, mobility of the Pch transistor 202, the Pch transistor 501, and the Pch transistor 502; L6, a transistor L-length of the Pch transistor 202; L5, a total transistor L-length of the Pch transistor 501 and the Pch transistor 502; W6, a transistor W-length of the Pch transistor 202; and W5, a transistor W-length of the Pch transistor 501 and the Pch transistor 502.

Figure 6:
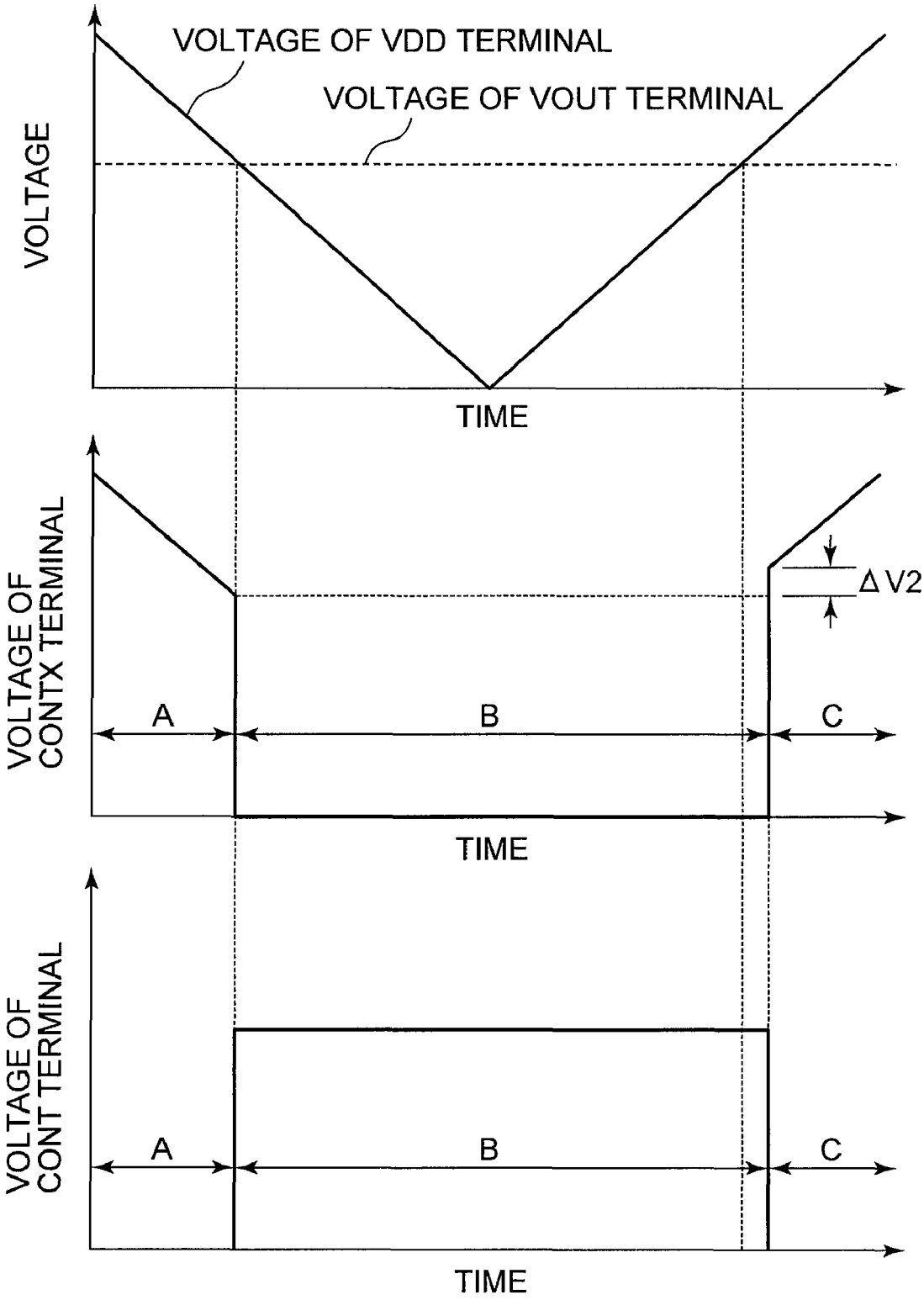
FIG. 6 illustrates voltage waveforms of respective portions of the voltage regulator according to the third embodiment of the present invention.

FIG. 6 illustrates voltage waveforms of the CONT terminal 223 and the CONTX terminal 222 of when the voltage of the output terminal 122 is constant while the voltage of the VDD terminal 121 changes. When the voltage of the VDD terminal 121 decreases to be equal to the voltage of the output terminal 122, the voltage of the CONT terminal 223 and the voltage of the CONTX terminal 222 are inverted. Thereafter, the voltage of the VDD terminal 121 is raised, and when the voltage of the VDD terminal 121 becomes higher by ΔV2 than the voltage of the output terminal 122, the voltage of the CONT terminal 223 and the voltage of the CONTX terminal 222 are inverted. As described above, hysteresis is provided between the voltage of the VDD terminal 121 and the voltage of the output terminal 122, between which the substrate (Nwell) potential of the Pch transistor 103 is switched over. This enables the switching-over of the substrate (Nwell) potential of the Pch transistor 103 to be securely performed without a malfunction even when the voltage of the VDD terminal 121 and the voltage of the output terminal 122 become approximate to each other.

Note that, in order to prevent a parasitic diode formed between the VDD terminal 121 and the substrate of the Pch transistor 103 from being turned ON when the voltage of the VDD terminal 121 increases, the value of ΔV2 needs to be set to a forward ON voltage (about 0.6 V) or lower of the parasitic diode. In general, the value of ΔV2 is set to about 50 mV to 200 mV.

Further, the Pch transistor 503 is connected in parallel with the Pch transistor 501 in FIG. 5, but it is obvious that a similar effect may be obtained when the Pch transistor 503 is connected in parallel with the Pch transistor 502. Further, as has been described in the first embodiment, with regard to the error amplifier, it is desirable to adopt the configuration illustrated in FIG. 9 similarly to the first embodiment.

The invention claimed is:

1. A voltage regulator, comprising:

an output transistor that is provided between a power supply terminal and an output terminal;

an error amplifier for controlling a gate voltage of the output transistor so that a voltage of the output terminal becomes constant;

a second transistor for connecting a substrate of the output transistor with the power supply terminal;

a third transistor for connecting the substrate of the output transistor with the output terminal; and a comparator circuit for comparing a voltage of the power supply terminal with the voltage of the output terminal, and performing control of switching the second transistor and the third transistor based on a result of the comparing, wherein:

the comparator circuit comprises:

a fourth transistor having a source connected with the power supply terminal, a gate connected with a drain, and the drain connected with a first constant current circuit; and a fifth transistor having a source connected with the output terminal, a gate connected with the gate of the fourth transistor, and a drain connected with a second constant current circuit; and the comparator circuit outputs the result of the comparing based on a voltage of a connection point between the fifth transistor and the second constant current circuit.

2. A voltage regulator according to claim 1, wherein the comparator circuit is configured to:

turn ON the second transistor when the voltage of the power supply terminal is higher than the voltage of the output terminal; and turn ON the third transistor when the voltage of the power supply terminal is lower than the voltage of the output terminal.

3. A voltage regulator according to claim 2, wherein the comparator circuit has a hysteresis function.

4. A voltage regulator according to claim 3, wherein: the comparator circuit further comprises:

a sixth transistor that is connected in series with the fifth transistor; and a seventh transistor that is connected in parallel with the fifth transistor; and the hysteresis function is realized by controlling the seventh transistor based on the output of the comparator circuit.

5. A voltage regulator according to claim 4, wherein:

the comparator circuit further comprises:

an eighth transistor that is connected in series with the fourth transistor; and a ninth transistor that is connected in parallel with the fourth transistor; and the hysteresis function is realized by controlling the ninth transistor based on the output of the comparator circuit.

6. A voltage regulator, comprising:

an output transistor that is provided between a power supply terminal and an output terminal;

an error amplifier for controlling a gate voltage of the output transistor so that a voltage of the output terminal becomes constant;

a second transistor for connecting a substrate of the output transistor with the power supply terminal;

a third transistor for connecting the substrate of the output transistor with the output terminal; and a comparator circuit for comparing a voltage of the power supply terminal with the voltage of the output terminal, and performing control of switching the second transistor and the third transistor based on a result of the comparing, wherein:

the comparator circuit comprises:

a fourth transistor having a source connected with the power supply terminal, a gate connected with a drain, and the drain connected with a first constant current circuit;

a fifth transistor having a source connected with the output terminal, a gate connected with the gate of the fourth transistor, and a drain connected with a second constant current circuit;

a sixth transistor that is connected in series with the fifth transistor; and a seventh transistor that is connected in parallel with the fifth transistor, wherein a hysteresis function is realized by controlling the seventh transistor based on the output of the comparator circuit; and the comparator circuit outputs the result of the comparing based on a voltage of a connection point between the fifth transistor and the second constant current circuit.

7. The voltage regulator according to claim 6, wherein the comparator circuit is configured to:

turn ON the second transistor when the voltage of the power supply terminal is higher than the voltage of the output terminal; and turn ON the third transistor when the voltage of the power supply terminal is lower than the voltage of the output terminal.

8. The voltage regulator according to claim 6, wherein the comparator circuit further comprises:

an eighth transistor that is connected in series with the fourth transistor; and a ninth transistor that is connected in parallel with the fourth transistor; and the hysteresis function is realized by controlling the ninth transistor based on the output of the comparator circuit.

* * * * *